US009976401B2

(12) United States Patent
Walton et al.

(10) Patent No.: US 9,976,401 B2
(45) Date of Patent: May 22, 2018

(54) EROSION RESISTANT BAFFLE FOR DOWNHOLE WELLBORE TOOLS

(71) Applicant: Halliburton Energy Services, Inc., Houston, TX (US)

(72) Inventors: Zachary William Walton, Coppell, TX (US); Matthew James Merron, Carrollton, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 102 days.

(21) Appl. No.: 15/021,751

(22) PCT Filed: Oct. 21, 2013

(86) PCT No.: PCT/US2013/065863

§ 371 (c)(1),
(2) Date: Mar. 14, 2016

(87) PCT Pub. No.: WO2015/060809

PCT Pub. Date: Apr. 30, 2015

(65) Prior Publication Data

US 2016/0230504 A1 Aug. 11, 2016

(51) Int. Cl.

| | |
|---|---|
| ***E21B 34/14*** | (2006.01) |
| ***E21B 43/14*** | (2006.01) |
| *E21B 34/00* | (2006.01) |

(52) U.S. Cl.

CPC ..... *E21B 43/14* (2013.01); *E21B 34/14* (2013.01); *E21B 2034/007* (2013.01)

(58) Field of Classification Search

CPC ..... E21B 43/14; E21B 34/14; E21B 2034/007
See application file for complete search history.

(56) References Cited

U.S. PATENT DOCUMENTS

| | | | | |
|---|---|---|---|---|
| 4,510,994 | A * | 4/1985 | Pringle | E21B 23/04 166/156 |
| 7,182,135 | B2 | 2/2007 | Szarka | |
| 2009/0159274 | A1 | 6/2009 | Frazier | |
| 2009/0159289 | A1 | 6/2009 | Avant et al. | |
| 2010/0032151 | A1 * | 2/2010 | Duphorne | E21B 23/02 166/55 |
| 2012/0012771 | A1 * | 1/2012 | Korkmaz | E21B 23/04 251/315.07 |

(Continued)

FOREIGN PATENT DOCUMENTS

WO 2012141842 A2 10/2012

OTHER PUBLICATIONS

International Search Report and Written Opinion issued by the Korean Intellectual Property Office regarding International Application No. PCT/US2013/065863, dated Jul. 14, 2014, 17 pages.

(Continued)

*Primary Examiner* — Brad Harcourt
(74) *Attorney, Agent, or Firm* — Haynes and Boone, LLP

(57) ABSTRACT

Disclosed herein is a seat assembly for use in wellbore servicing systems, comprising a cylindrical baffle with an annular shaped seat with an upward facing seat for receiving an obturator, the seat defining a central passageway. Erosion resistance rings are placed inside of and in front the baffle to protect the baffle and seat from erosion cause by treatment fluids and solids passing through the servicing system.

25 Claims, 9 Drawing Sheets

(56) References Cited

U.S. PATENT DOCUMENTS

| | | | |
|---|---|---|---|
| 2012/0125631 | A1 | 5/2012 | Entchev et al. |
| 2012/0205121 | A1 | 8/2012 | Porter |
| 2012/0261131 | A1 | 10/2012 | Hofman |
| 2013/0153220 | A1 | 6/2013 | Carter |

OTHER PUBLICATIONS

Extended European search report Issued by the European Patent Office related to European Patent Application No. 13895955, dated Apr. 11, 2017, 8 pages.

Patent Examination Report No. 1 Issued by the Australian Government related to Australian Patent Application No. 2013403420, dated Jun. 7, 2016, 3 pages.

* cited by examiner

EROSION RESISTANT BAFFLE FOR DOWNHOLE WELLBORE TOOLS

CROSS-REFERENCE TO RELATED APPLICATIONS

This application is a national stage entry of International Application No. PCT/US2013/065863 filed on Oct. 21, 2013, the entire disclosure of which is hereby incorporated herein by reference.

STATEMENT REGARDING FEDERALLY SPONSORED RESEARCH OR DEVELOPMENT

Not applicable.

REFERENCE TO A MICROFICHE APPENDIX

Not applicable.

BACKGROUND

It is common to utilize downhole wellbore equipment with baffles containing seats for use in operating of the equipment. For example, well formations that contain hydrocarbons are sometimes non-homogeneous in their composition along the length of wellbores that extend into such formations. It is sometimes desirable to treat and/or otherwise manage the formation and/or the wellbore differently in response to the differing formation composition. Some wellbore servicing systems and methods allow such treatment, referred to by some as zonal isolation treatments. In these systems, zones can be treated separately.

In some treatment methods a plurality of spaced tools are installed in a well and selectively operated. For example, in some well treatment systems a plurality of sleeve valves are installed in the well and opened in sequence starting with the bottom most valve. Once treatment through the bottom most valve is completed, the next higher up valve is opened and treatment performed through that valve.

In obturator actuated systems, an obturator is transported down the wellbore to engage a downhole well tool. The terms, "up", "upward", "down" and "downward", when used to refer to the direction in the well bore without regard to the orientation of the well bore. Up, upward and up hole refer to the direction toward the well head. Down, downward, and down hole refer to a direction away from the well head. In these systems, each downhole well tool typically includes a metallic baffle containing seat to seal against the obturator and activate the tool.

It is common to perform fracturing formation treatments using multiple sleeve valves spaced along the well. Fracturing necessarily involves pumping large quantities of abrasive materials called proppants at high pressures and high flow rates into the well and through the baffles in these valves. As a frac treatment material flow through the valves their baffles are subject to erosion damage. The potential damage can be more severe when the upper valves in a wellbore are subjected to erosion effects of multiple frac operations accounted with the lower valves.

Accordingly, there exists a need for erosion resistant for use in systems and methods for treating multiple zones of a wellbore.

SUMMARY

Disclosed herein are wellbore tool baffles for use in abrasive wellbore servicing systems and methods. In the disclosed example the baffle is armored against erosion damage from materials flowing through the tool.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
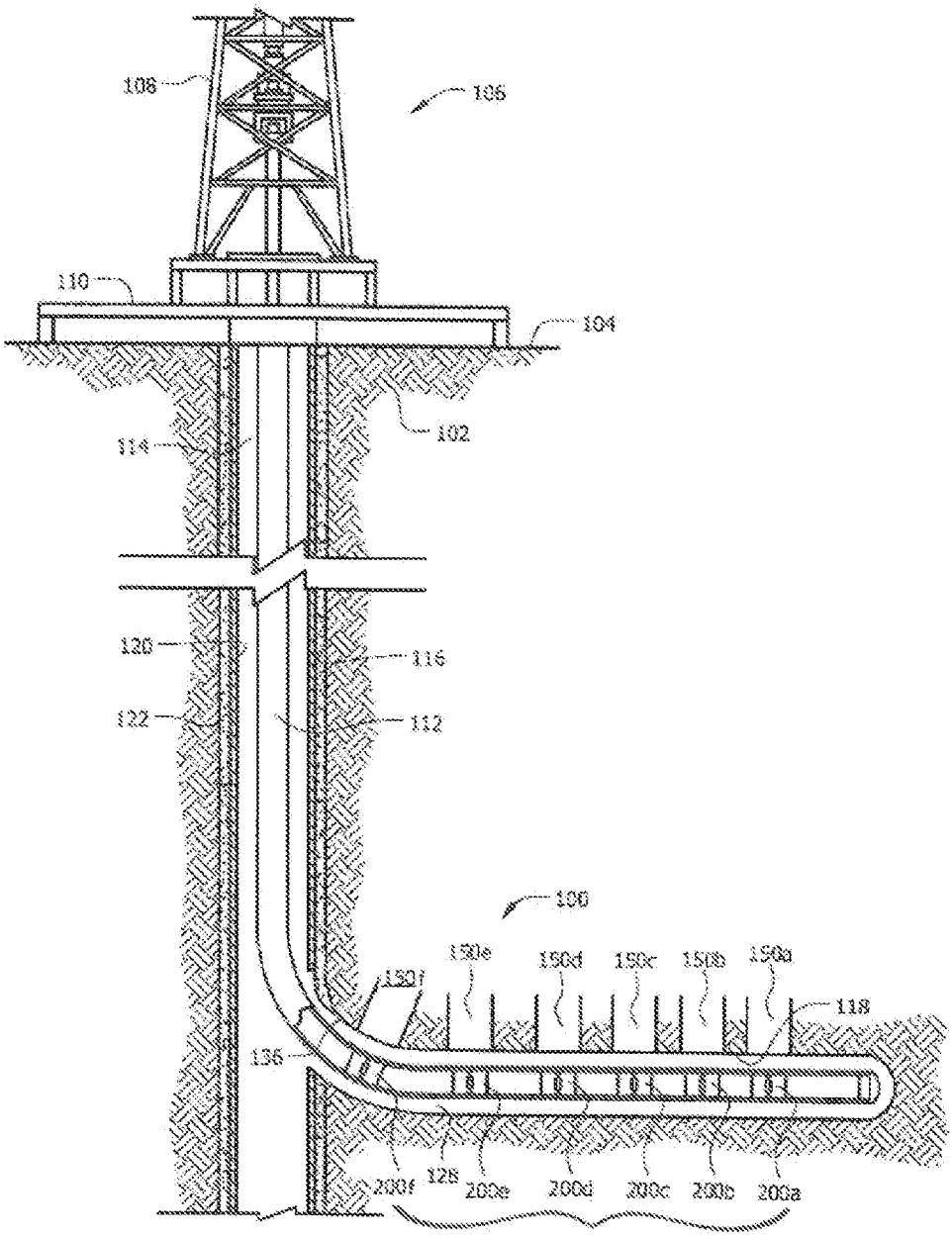
FIG. 1 is a cut-away view of an embodiment of a wellbore servicing system according to the disclosure containing multiple well tools.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ." Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. The term "zone" or "pay zone" as used herein refers to separate parts of the wellbore designated for treatment or production and may refer to an entire hydrocarbon formation or separate portions of a single formation such as horizontally and/or vertically spaced portions of the same formation. The various characteristics mentioned above, as well as other features and characteristics described in more detail below, will be readily apparent to those skilled in the art with the aid of this disclosure upon reading the following detailed description of the embodiments and by referring to the accompanying drawings.

Disclosed herein are improved components, more specifically, an improved baffle assembly with erosion resistance characteristics, for use in downhole tools. Such a baffle may be employed alone or in combination with other components.

Referring to FIG. 1, an embodiment of a wellbore servicing system 100 is shown in an example of an operating environment. As depicted, the operating environment comprises a rig 106 (e.g., a drilling, completion, or workover rig) positioned on the earth's surface 104 over a wellbore 114 that penetrates a subterranean formation 102 for the purpose of recovering hydrocarbons. The wellbore 114 may be drilled into the subterranean formation 102 using any suitable drilling technique. The wellbore 114 extends substantially vertically away from the earth's surface 104 over a vertical wellbore portion 116, deviates from vertical relative to the earth's surface 104 over a deviated wellbore portion 136, and transitions to a horizontal wellbore portion 118. In alternative operating environments, all or portions of a wellbore may be vertical, deviated at any suitable angle, horizontal, and/or curved.

At least a portion of the vertical wellbore portion 116 is lined with a casing 120 that is secured into position against the subterranean formation 102 in a conventional manner using cement 122. In alternative operating environments, a horizontal wellbore portion may be cased and cemented and/or portions of the wellbore may be uncased. The rig 106 comprises a derrick 108 with a rig floor 110 through which a tubing or work string 112 (e.g., cable, wireline, E-line, Z-line, jointed pipe, coiled tubing, casing, or liner string, etc.) extends downward from the servicing rig 106 into the wellbore 114 and defines an annulus 128 between the work string 112 and the wellbore 114. The work string 112 delivers the wellbore servicing system 100 to a selected depth within the wellbore 114 to perform an operation such as perforating the casing 120 and/or subterranean formation 102, creating perforation tunnels and/or fractures (e.g., dominant fractures, micro-fractures, etc.) within the subterranean formation 102, producing hydrocarbons from the subterranean formation 102, and/or other completion operations. The servicing rig 106 comprises a motor driven winch and other associated equipment for extending the work string 112 into the wellbore 114 to position the wellbore servicing system 100 at the selected depth.

While the operating environment depicted in FIG. 1 refers to a stationary servicing rig 106 for lowering and setting the wellbore servicing system 100 within a land-based wellbore 114, in alternative embodiments, mobile workover rigs, wellbore servicing units (such as coiled tubing units), and the like may be used to lower a wellbore servicing system into a wellbore. It should be understood that a wellbore servicing system may alternatively be used in other operational environments, such as within an offshore wellbore operational environment.

The subterranean formation 102 comprises a zone 150 associated with deviated wellbore portion 136. The subterranean formation 102 further comprises first, second, third, fourth, and fifth horizontal zones, 150*a*, 150*b*, 150*c*, 150*d*, 150*e*, respectively, associated with the horizontal wellbore portion 118. In this embodiment, the zones 150, 150*a*, 150*b*, 150*c*, 150*d*, 150*e* are offset from each other along the length of the wellbore 114 in the following order of increasingly downhole location: 150, 150*e*, 150*d*, 150*c*, 150*b*, and 150*a*. In this embodiment, stimulation and production sleeve systems 200, comprising sleeve valves 200*a*, 200*b*, 200*c*, 200*d*, 200*e*, and 200*f* are located within wellbore 114 in the work string 112 and are associated with zones 150, 150*a*, 150*b*, 150*c*, 150*d*, and 150*e*, respectively. It will be appreciated that zone isolation devices such as annular isolation devices (e.g., annular packers and/or swellpackers) may be selectively disposed within wellbore 114 in a manner that restricts fluid communication between spaces immediately uphole and downhole of each annular isolation device.

The stimulation and production sleeve systems 200 illustrated in FIG. 1 each sleeve valve comprises one or more sleeves which can be moved to selectively open ports spaced along the wall of the work string 112 to provide a fluid paths between the interior of the work string and the surrounding formation. In the stimulation and production sleeve systems 200 illustrated in FIG. 1 the sleeve valves 200*a*-200*f* can be opened in sequence starting with opening the ports associated bottom most sleeve valve 200*a*. Sleeve valve 200*a* is opened by inserting an obturator into the well to contact a seat on a baffle in the valve. With the valve 200*a* open horizontal zone 150*a* can be treated by pumping fluids into the zone through the ports opened by valve 200*a*. Once valve 200*a* is opened and treatment through this bottom most valve 200*a* is completed, the next higher up valve 200*b* is opened and treatment performed through that valve. Next the valve 200*b* is opened to treat zone 150*b*. The valves 200*b*-200*f* each also comprises a baffle with seat which with the obturator block or seals off the interior of the work string 112 below the valve. This sequence can be repeated for each of the sleeve valves 200*c*-200*f* until the uppermost sleeve valve 200*f* is actuated and used to treat zone 150*f*.

Figure 2:
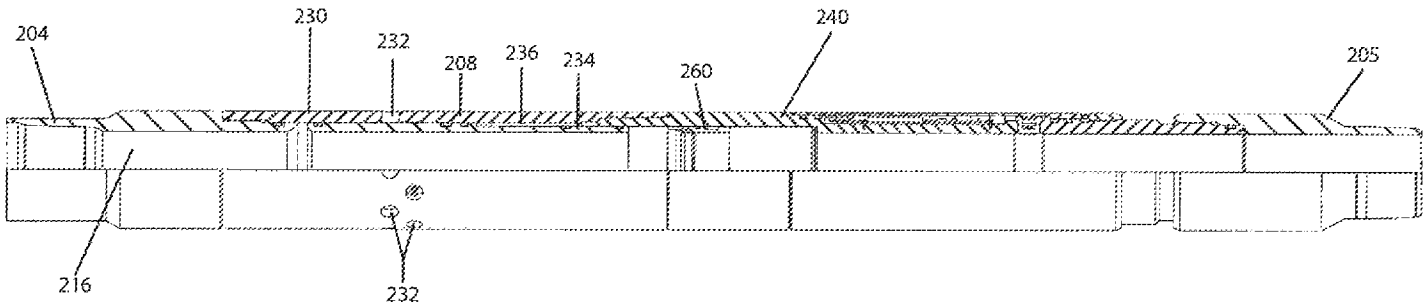
FIG. 2 is a cross-sectional view of a sleeve valve containing an embodiment of the baffle of the present invention for use in the wellbore servicing system of FIG. 1 showing the sleeve valve in the run-in configuration.

Referring now to FIG. 2, a cross-sectional view of an embodiment of sleeve valve 200*a* of the stimulation and production sleeve system 200 (hereinafter referred to as "sleeve system" 200) is shown. Valve 200*a* is typical of the construction of the valves 200*b*-200*f*. Many of the components of sleeve valve 200*a* lie substantially coaxial with a central axis 202 of sleeve valve 200*a*.

Sleeve valve 200*a* comprises an upper adapter 204, a lower adapter 206, and a ported case assembly 208. The ported case assembly 208 is joined between the upper adapter 204 and the lower adapter 206. Together, inner surfaces of the upper adapter 204, the lower adapter 206, and the ported case assembly 208, respectively, substantially define a sleeve flow bore 216. The upper adapter 204 comprises a collar configured for attachment to an element of work string 112. The lower adapter 206 is configured for attachment to an element of work string 112. The upper and lower adapters comprise threads for connecting to the ported case assembly 208 and work string 112.

The ported case assembly 208 is substantially tubular in shape and comprises an upper sleeve portion 230 and a lower baffle portion 240. The sleeve portion 230, baffle portion 240, upper adapter 204 and lower adapter 206 each have substantially the same inner and outer diameters. The upper sleeve portion 230 further comprises ports 232. As will be explained in further detail below, ports 232 are through holes extending radially through the upper sleeve portion 230 and are selectively used to provide fluid communication between sleeve flow bore 216 and the annulus 128 immediately exterior to the upper sleeve portion 230.

Figure 7:
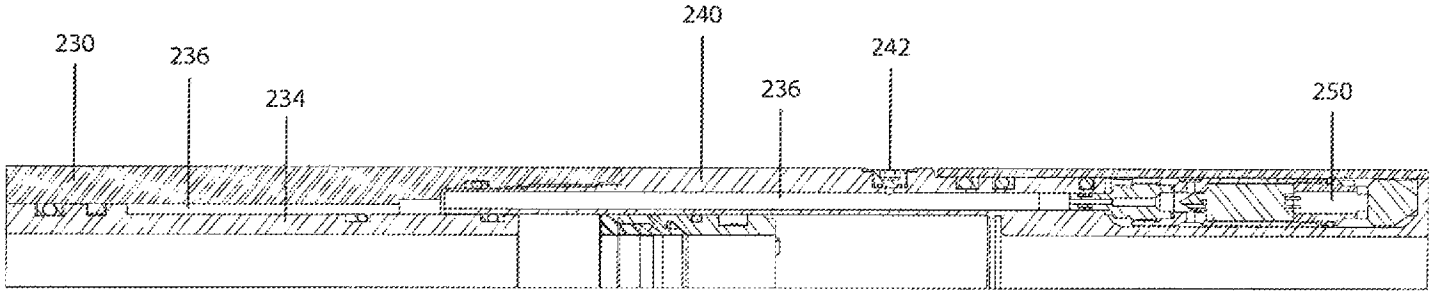
FIG. 7 is an enlarged cross-sectional view of the sleeve valve of FIG. 2 illustrating details of the electro-hydraulic sleeve lock.
Figure 8:
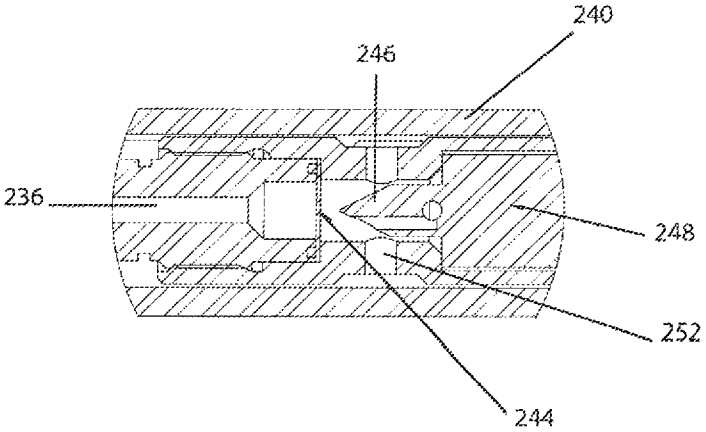
FIG. 8 is an enlarged section view of the electro-hydraulic actuator of the sleeve system of FIG. 7.

The upper sleeve portion 230 comprises a sleeve 234 mounted to slide axially within the sleeve portion 232 selectively block and open ports 232. As is illustrated FIG. 2 and in detail in FIGS. 7 and 8, sleeve 234 is hydraulically locked in the upper or run in position illustrated in FIG. 2. In FIGS. 2, 7 and 8, the upper or uphole direction is to the left sides of each figure. Sleeve 234 is held in this position by filling annular chamber 236 with a hydraulic fluid. Chamber 236 extends from sleeve portion 230 and into baffle portion 240. Chamber 236 can be filled with hydraulic fluid using removable plug 242. A rupture disk 244 closes off the lower end of chamber 236. When rupture disk 244 is pierced or broken, hydraulic fluid in chamber 236 is vented, the position of sleeve 234 is unlocked, allowing sleeve 234 to axially slide in the downhole direction (to the right side of the page).

The structure for piercing the rupture disk 244 is best illustrated in reference to FIGS. 7 and 8 and various embodiments are disclosed in U.S. Pat. No. 8,322,426 and U.S. Publications 2013/0048290 and 2013/0048291, which are incorporated herein by reference for all purposes. The piercing structure comprises a cutter 246, actuator 248 and electronic package 250. In the illustrated embodiment the actuator 248 comprises an explosive charge which when ignited by the electronic package 250 drives the cutter 246 in the uphold direction to pierce rupture disk 244. Electronic package 250 comprises means for sensing and recording the passage along the sleeve bore 216 of obturators passing through the sleeve valve 200*a*. When a set number of obturators pass through the valve 200*a*, electronic package 258 initiates the actuator 248. Porting 252 provides a path for the hydraulic fluid to vent from chamber 236 into flow bore 216.

Figure 9:
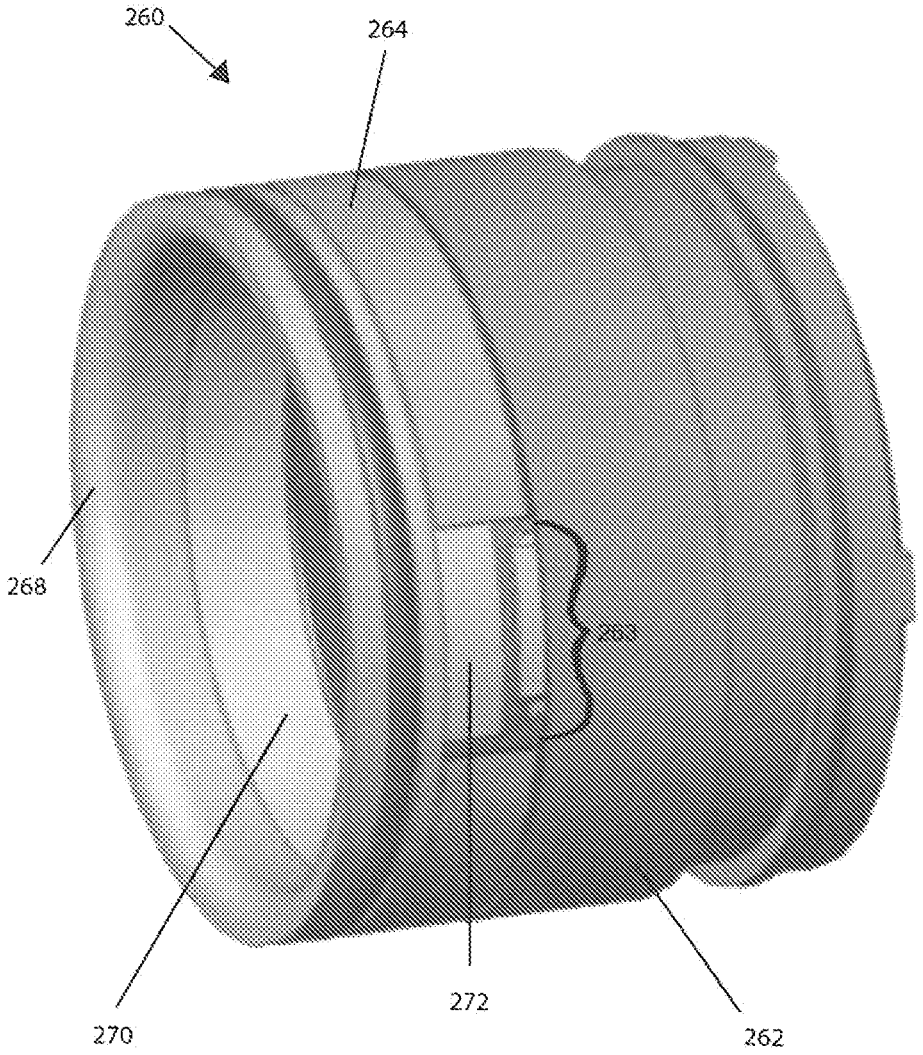
FIG. 9 is a perspective view of an embodiment of the baffle in the sleeve valve of FIG. 2.

The baffle portion 240 (240 also encloses the electronics, batteries, thruster, and rupture disc) comprises an annular baffle assembly 260 mounted in the bore of the baffle portion 242 to slide axially in the flow bore 216. The details of construction of the baffle assembly will be described in more detail by reference to FIGS. 8 and 9. The baffle assembly 260 comprises a sleeve 262 and a C-ring baffle 264 having an uphole facing seat 266. Sleeve 262 is held in axial position in the baffle 240 illustrated in FIG. 7 by a releasable mechanism such as a shear pin or snap ring (not shown). As will be described, baffle 264 is illustrated in its expanded condition where in its internal diameter is substantially the same as sleeve 262 and the gap 263 is present in the C-ring structure. In the position illustrated in FIG. 10 the seal ring comprising baffle 264 is spring-loaded are resiliently urged radially outward to engage sleeve 262. Baffle 264 has tabs 267 which lock into a groove in sleeve 266; this axially holds the baffle 264 in position. (they are locked together axially only in the state where the baffle is expanded). As will be described in more detail, when baffle 264 and sleeve 266 are forced together (by axial forces Fs and Fb) baffle 264 will climb up (should this read down?) the ramp services and tabs 267 to a point where the gap 263 in the C-ring structure of baffle 264 is closed and the internal diameter of the baffle 264 is less than the internal diameter of the sleeve 262. When the baffle 264 is in the expanded position illustrated in FIG. 10, an obturator with an external diameter less than that of the sleeve 266 will pass through the baffles 264 without engaging it. It should be appreciated that when the baffle 264 contracts, that it can be of a sufficiently small internal diameter to engage an obturator.

Figure 10:
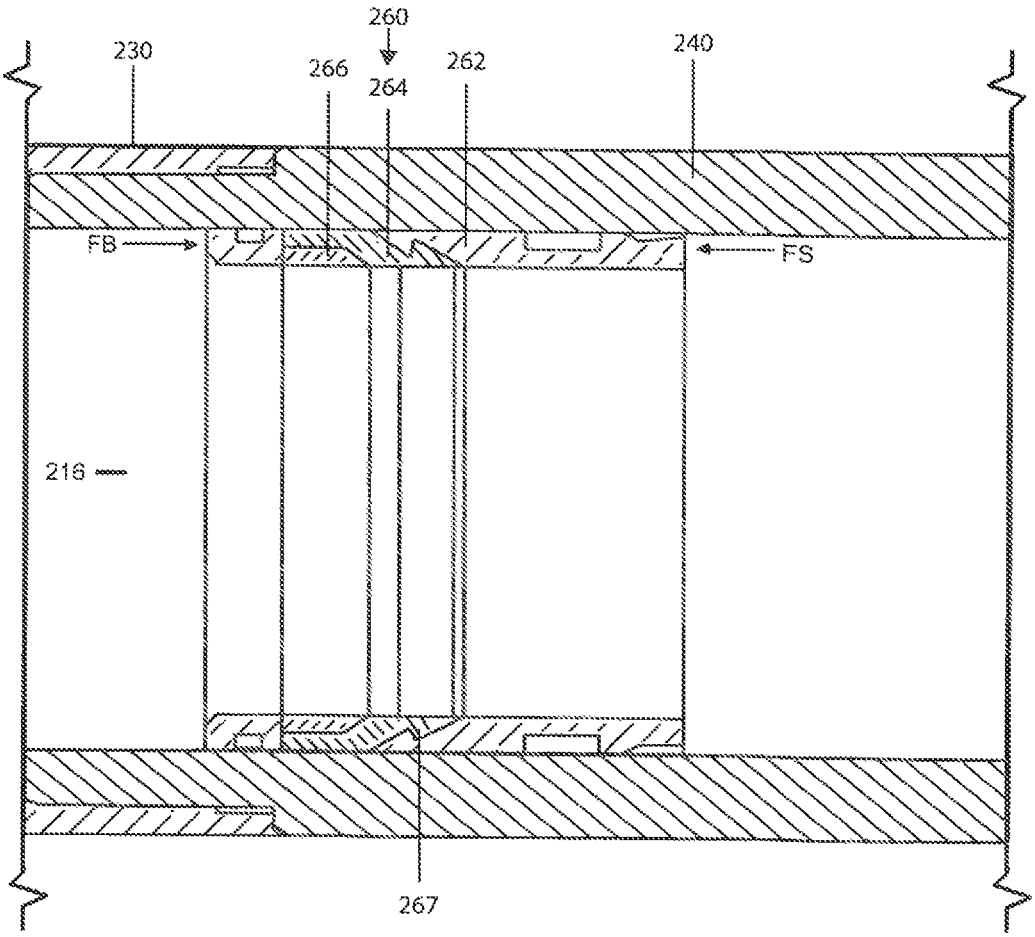
FIG. 10 is a top plan view of third alternative embodiment of the seat assembly of the sleeve system of FIG. 2.

To protect the baffle 264 and the seat 266 against erosion from flowing treatment materials, a baffle erosion buffer or shield is provided. This shield allows the system to be used to treat a greater number of treatment zones (treatment stages). In the illustrated embodiment, the shield comprises a nose cone ring 268 and a seat abutting ring 270. The nose cone ring 268 as substantially the same into your an exterior diameters as the sleeve 262 and baffle 264 when arranged as illustrated in FIGS. 2, 7 and 10. The annular surface of the ring 268 facing in the upward direction is tapered or rounded or angled to reduce flow turbulence. Turbulent flow has a more erosive impact on the components; an angled or rounded face reduces flow turbulence. Ring 268 can be formed from an erosion resistant material such as carbide, hard steel or the like.

The seat abutting ring 270 is located downhole of the nose cone ring 268 and inside of the baffle 264. Ring 268 has a section 272 that covers the gap 263 to provide a continuous cylindrical surface on the interior of the baffle assembly 260 to reduce turbulence and the erosion of fact a flow there through. In this embodiment the seat abutting ring 270 is made from a frangible material, such as, ceramic, cast-iron, phenolic are similar brittle erosion (abrading affect or particle impact affect which erode/corrode the material) resistant materials.

The operation sleeve system 200 will be described by reference to FIGS. 2-8. The system 200 is of the type which is used in conjunction with an obturator 280 comprising magnetic material. In the present embodiment, the obturator 280 is a spherical ball formed from the nonmagnetic material with a number of cylindrical magnets installed in the outer diameter of the obturator 282 created a magnetic field around the outer diameter.

Prior to running the sleeve system 200 into the well, the electronic package of each of the stimulation and production sleeve valves 200*a*-200*f* is programmed to count a certain number of obturators 280 passing through the valve. The run-in condition of valve 200*a* is illustrated in FIG. 2 with the baffle 264 in the expanded our pass through condition. The run-in and operation of valve 200*a* is typical of the run in operation of valves 200*b*-200*f*.

Figure 3:
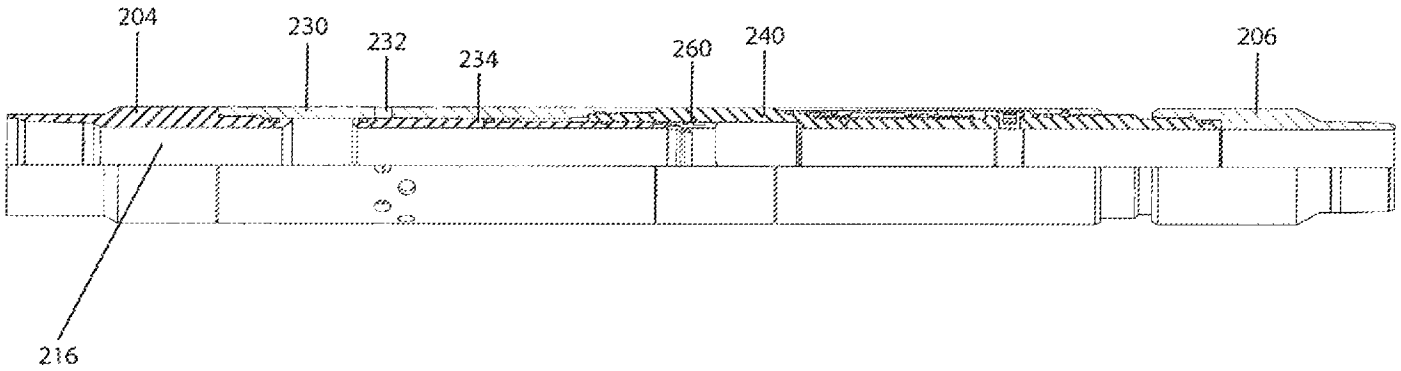
FIG. 3 is a cross-sectional view of a sleeve valve containing an embodiment of the baffle of the present invention for use in the wellbore servicing system of FIG. 1 showing the sleeve valve in the actuated baffle configuration.

In FIG. 3, the baffle 264 has been activated by the electronic package 250 sensing the passage of a set number of obturators 280 through the sleeve valve 200*a*. If for example, electronic package 250 of valve 200*a* has been programmed to release the hydraulic lock on sleeve 234 after the passage of a single obturator 280, then sleeve 234 moves in a downhole direction to contact the baffle assembly 260. This movement of sleeve 234 causes the baffle 264 to ride down the ramp services and tabs 267 and contract to assume the obturator catching position illustrated in FIG. 3. As the baffle 264 contracts the frangible seat abutting ring 270 breaks apart and fall down the wellbore. It is to be noted that at this point, that even though the sleeve 234 has moved downward the ports 230 remain blocked.

Figure 4:
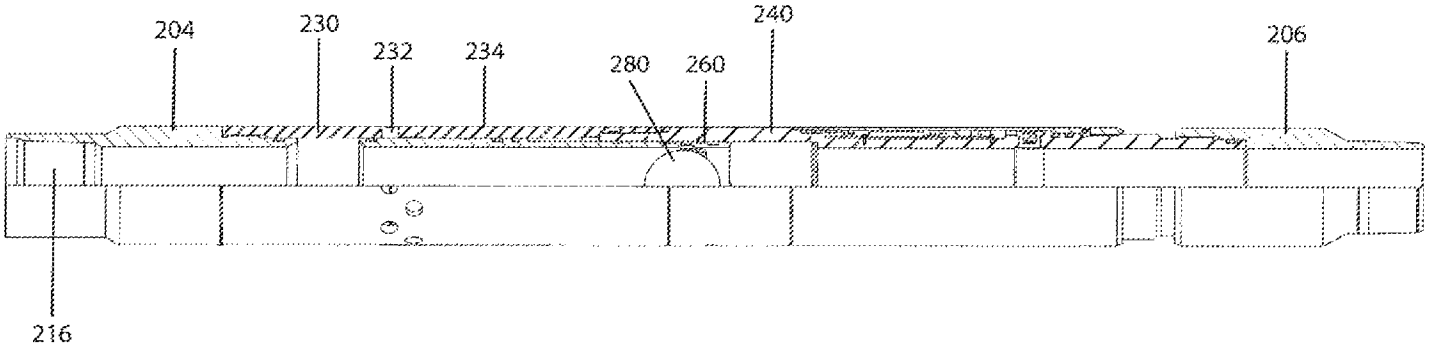
FIG. 4 is a cross-sectional view of a sleeve valve containing an embodiment of the baffle of the present invention for use in the wellbore servicing system of FIG. 1 showing the sleeve valve with the ball landed on the baffle seat configuration.
Figure 5:
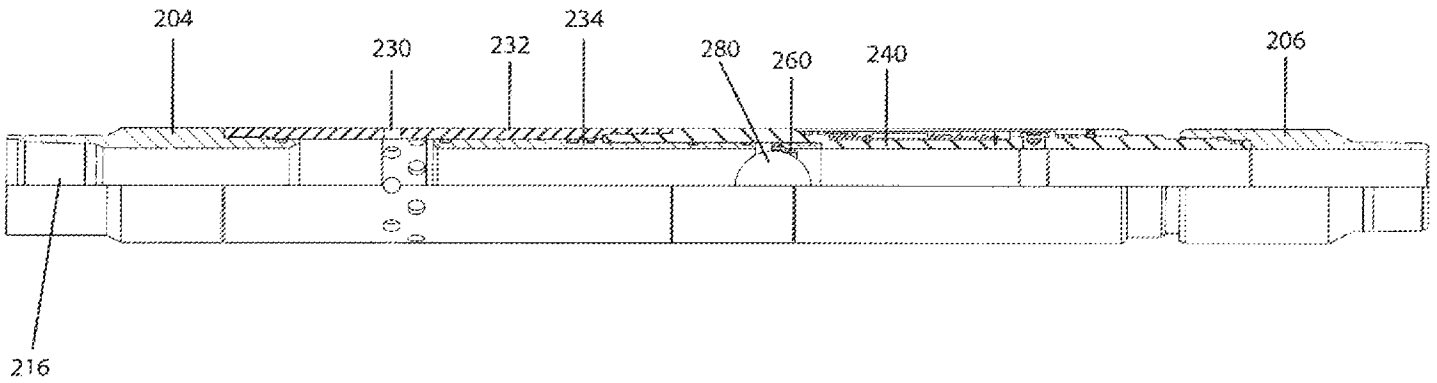
FIG. 5 is a cross-sectional view of a sleeve valve containing an embodiment of the baffle of the present invention for use in the wellbore servicing system of FIG. 1 showing the sleeve valve in the open configuration.
Figure 6:
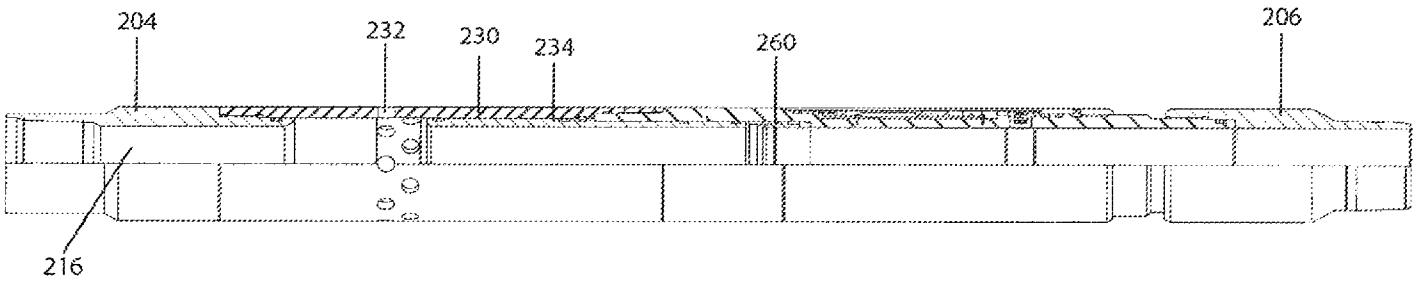
FIG. 6 is a cross-sectional view of a sleeve valve containing an embodiment of the baffle of the present invention for use in the wellbore servicing system of FIG. 1 showing the sleeve valve in the open flowback configuration.

The next step in the operation of valve 200*a* is illustrated in FIG. 4. In this step, the next obturator 280 moving down the wellbore engages baffle 264 and seals against the seat 266. With the obturator 280 in this position, the lower portion of the work string 212 below valve 200*a* is sealed off. In this step, sleeve 262 is held in axial position by the shear pins, are the light (not shown).

With the obturator 280 landed on the baffle 264, pressure in the work string 212 is raised to the point where the force on the sleeve 262 causes the shear pins to release. With the pins shared sleeve 262 and sleeve 234 move in a downhole direction to the position illustrated in FIG. 5. In this position sleeve 234 has moved away from ports 230 opening up a flow pathway between a flow bore 216 and annulus 128. In this position treatment? fluid can be pumped down the work string 112 to treat the horizontal zone 150*a*. The obturator 280 and baffle seat 266 block are prevent flow of treatment fluids from passing downhole through the valve 200*a*.

The above-described process is then repeated for all of the sleeve valves 200*b*-200*f*. Once the treatments are completed, the pressure in work string 112 is reduced, flow back from the various zones will force the balls to flow back up the well to the rig 106 where they are recovered from the well. As the balls flow up the work string 112, the balls will contact the baffles 264 and force them into the expanded position illustrated in FIG. 6. Expanding the baffles 264 eliminates the flow restriction resulting from the contracted baffle position illustrated in FIG. 5.

In some embodiments, operating a wellbore servicing system such as wellbore servicing system 100 may comprise providing a first sleeve system (e.g., of the type of sleeve systems 200) in a wellbore and providing wellbore servicing pumps and/or other equipment to produce a fluid flow through the sleeve flow bores of the sleeve system. Subsequently, an obturator may be introduced into the fluid flow so that the obturator travels downhole and into engagement with the seat of a baffle in first sleeve valve. When the obturator contacts the seat, fluid pressure may be increased to cause the first sleeve system to open ports to provide treatment paths.

In the described embodiments, a method of performing a wellbore servicing operation may comprise providing a work string comprising a plurality of sleeve systems in a configuration as described above and positioning the work string within the wellbore such that one or more of the plurality of sleeve systems is positioned proximate and/or substantially adjacent to one or more of the zones. The zones may be isolated, for example, by actuating one or more packers or similar isolation devices.

In the described embodiments, a method of performing a wellbore servicing operation may comprise providing well casing comprising a plurality of sleeve systems in a configuration as described above and positioning the casing such that one or more of the plurality of sleeve systems is positioned proximate and/or substantially adjacent to one or more of the zones. The zones may be isolated, for example, by actuating one or more packers or similar isolation devices One of skill in the art will appreciate that the servicing fluid communicated to the zone may be selected dependent upon the servicing operation to be performed. Nonlimiting examples of such servicing fluids include a fracturing fluid, a hydrajetting or perforating fluid, an acidizing, an injection fluid, a fluid loss fluid, a sealant composition, or the like.

Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A seat assembly for placement in subterranean wellbore equipment for engagement with an obturator, the seat assembly comprising:

an annular-shaped body configured to deform from a larger internal diameter expanded shape to a smaller internal diameter contracted shape, the body comprising a seat having a surface of a size and shape to engage the obturator when the body is in the contracted shape; and a frangible shield mounted on the body when the body is in the expanded shape so that the frangible shield abuts the obturator engaging surface of the seat, wherein the frangible shield is adapted to break up as the body is deformed from the expanded shape to the contracted shape.

2. The seat assembly according to claim 1, wherein the body comprises a generally cylindrical-shaped outer wall, a central bore extending through the body, and an axially-extending cut in the outer wall of the body, and wherein, when the body is in the expanded shape, the cut in the outer wall of the body forms an axially-extending gap.

3. The seat assembly according to claim 2, wherein the frangible shield spans the gap in the outer wall.

4. The seat assembly according to claim 2, wherein the body has a plurality of axially-extending cuts dividing the body radially into a plurality of separate segments.

5. The seat according to claim 1, wherein the frangible shield comprises a cylinder.

6. The seat according to claim 1, wherein the frangible shield is formed using ceramic material.

7. The seat assembly according to claim 1, wherein the frangible shield is formed using cast iron material.

8. The seat assembly according to claim 1, wherein the frangible shield is formed using phenolic material.

9. The seat assembly according to claim 1, wherein the body has a C shaped cross section.

10. The seat assembly according to claim 1, wherein the obturator engaging surface of the seat has a surface that faces axially and radially inward.

11. The seat assembly according to claim 1, wherein the frangible shield lines the obturator engaging surface of the seat.

12. An apparatus for engaging an obturator in the central passageway of a tool connected to a tubing string at a subterranean location, the apparatus comprising:

an annular-shaped body positioned in the central passageway of the tool and configured to deform from a larger internal diameter expanded shape to a smaller internal diameter contracted shape, the body comprising a seat having a surface of a size and shape to engage the obturator when the body is in the contracted shape; and a frangible shield mounted on the body when the body is in the expanded shape so that the frangible shield abuts the obturator engaging surface of the seat, wherein the frangible shield is adapted to break up as the body is deformed from the expanded shape to the contracted shape.

13. The apparatus according to claim 12, wherein the body comprises a generally cylindrical-shaped outer wall, a central bore extending through the body, and an axially-extending cut in the outer wall of the body, and wherein, when the body is in the expanded shape, the cut in the outer wall of the body forms an axially-extending gap.

14. The apparatus according to claim 13, wherein the frangible shield spans the gap in the outer wall.

15. The apparatus according to claim 13, wherein the body has a plurality of axially-extending cuts dividing the body radially into a plurality of separate segments.

16. The apparatus according to claim 12, wherein the frangible shield comprises a cylinder.

17. The apparatus according to claim 12, wherein the frangible shield is formed using ceramic material.

18. The apparatus according to claim 12, wherein the frangible shield is formed using cast iron material.

19. The apparatus according to claim 12, wherein the frangible shield is formed using phenolic material.

20. The apparatus according to claim 12, wherein the annular body has a C shaped cross section.

21. The apparatus according to claim 12, wherein the obturator engaging surface of the seat has a surface that faces axially and radially inward.

22. The apparatus according to claim 12, wherein the frangible shield lines the obturator engaging surface of the seat.

23. A method for engaging an obturator moving through the central bore of a tool connected to a tubing string at a subterranean location, the method comprising:

providing an annular-shaped body deformable from a larger internal diameter expanded shape to a smaller internal diameter contracted shape, the body comprising a seat having a surface of a size and shape to engage the obturator when the body is in the contracted shape;

mounting a frangible shield on the body when the body is in the expanded shape so that the frangible shield abuts the obturator engaging surface of the seat;

positioning the body on which the frangible shield is mounted in the central bore of the tool; and deforming the body from the expanded shape to the contracted shape to break up the frangible shield and to deform the seat into the size and shape to engage the obturator.

24. The method according to claim 23, further comprising flowing treatment fluid through the central bore of the body before deforming the body from the expanded shape to the contracted shape.

25. The method according to claim 23, wherein the body comprises a generally cylindrical-shaped outer wall, a central bore extending through the body, and an axially-extending cut in the outer wall of the body, wherein, when the body is in the expanded shape, the cut in the outer wall of the body forms an axially-extending gap, and wherein mounting the frangible shield on the body when the body is in the expanded shape causes the frangible shield to span the gap in the outer wall.

* * * * *